United States Patent [19]

Morgan

[11] Patent Number: 5,040,916

[45] Date of Patent: Aug. 20, 1991

[54] SCAFFOLD FITTING

[76] Inventor: Richard M. Morgan, 1 Morgans Way, Summerhill, Stepaside, Dyfed SA67 8LU, United Kingdom

[21] Appl. No.: 488,075

[22] PCT Filed: Jan. 16, 1989

[86] PCT No.: PCT/GB89/00039

§ 371 Date: Jun. 18, 1990

§ 102(e) Date: Jun. 18, 1990

[87] PCT Pub. No.: WO89/06730

PCT Pub. Date: Jul. 27, 1989

[30] Foreign Application Priority Data

Jan. 15, 1988 [GB] United Kingdom ..... 8800884

[51] Int. Cl.[5] ..... B25G 3/36

[52] U.S. Cl. ..... 403/387; 403/400; 403/49

[58] Field of Search ..... 403/385, 49, 400, 387

[56] References Cited

U.S. PATENT DOCUMENTS

| | | | |
|---|---|---|---|
| 2,101,317 | 12/1937 | Lemieux | 403/385 X |
| 2,245,939 | 6/1941 | Schiller | 304/40 |
| 3,266,208 | 8/1966 | Maggs et al. | 403/49 X |

FOREIGN PATENT DOCUMENTS

| | | | |
|---|---|---|---|
| WO8704211 | 7/1987 | PCT Int'l Appl. . | |
| 879005 | 10/1961 | United Kingdom . | |
| 1535186 | 12/1978 | United Kingdom | 403/385 |
| 2073309 | 10/1981 | United Kingdom . | |

*Primary Examiner*—Andrew V. Kundrat

*Attorney, Agent, or Firm*—Edwin D. Schindler

[57] ABSTRACT

The scaffold fitting, which is for securing a scaffold tube to a steel plate or beam comprises a body (10) having a concave arcuate surface (20), a pivotal jaw (12) having a concave arcuate surface (18) arranged to face the arcuate surface (20). The jaw is pivotally mounted adjacent one end to the body and is provided with a clamping bolt (24) at the other end, the bolt being arranged to draw the jaw to the body to permit a scaffold tube to be gripped between said facing arcuate surfaces. A channel member (16) is secured to or integral with the obverse of the body, the channel member having opposed sidewalls arranged substantially perpendicular to the axis of the scaffold tube, the free ends of these sidewalls being remote from the body and having clamping bolts (38, 40) for clampingly engaging the steel plate or beam to one of the sidewalls.

4 Claims, 4 Drawing Sheets

SCAFFOLD FITTING

The present invention is concerned with scaffold fittings.

It is frequently desired to secure a scaffold tube to steelwork, such as an "H" beam, "U" beam or steel plate. Known devices of this type are disclosed in U.K. Specifications 1535209, 1537257 and 2111585; in all of these, the tube is secured to a flanged member on the steelwork in such a way that the tube is parallel to the flange. This means that an additional coupling is needed if it is desired to secure a tube at some other angle.

According to the present invention, there is provided a scaffold fitting for securing a scaffold tube to a steel plate or beam having a pair of opposed faces, which fitting comprises:

(a) a base portion having a concave arcuate surface;

(b) a pivotal jaw having a concave arcuate surface arranged to face the arcuate surface of said base portion, said jaw being pivotally mounted adjacent one end thereof to said base portion;

(c) clamping means provided on said base portion and arranged to engage the other end of said jaw and draw said jaw to said base portion and to grip a scaffold tube between said facing arcuate surfaces;

(d) a unitary channel member secured to or integral with the obverse of said base portion, said channel member comprising a connecting web member and a pair of opposed sidewalls, each of said sidewalls being in fixed orientation relative to the other of said sidewalls and being arranged substantially perpendicular to the axis of said tube, the free ends of said sidewalls being remote from said connecting web member; and (e) a plurality of bolts passing through corresponding threaded apertures in one of the sidewalls, said bolts being arranged substantially parallel to said connecting web member such that they can tighten directly on to one face of said steel plate or beam with the other face thereof in engagement with the other of said sidewalls The channel member is preferably integral with the base portion; in an alternative, the channel member may be pivotally connected to the base portion, in which case the channel member may be pivotal between an orientation of the web portion perpendicular to the axis of the scaffold tube and a range of orientations of the web portion inclined thereto.

The scaffold fitting according to the invention enables a scaffold tube to be hung vertically from a horizontal steel plate or beam, which permits a scaffolding structure to be secured directly to steelwork (in, for example, an off-shore oil rig).

Preferred embodiments of the present invention will now be described with reference to the accompanying drawings, in which.

Figure 1:
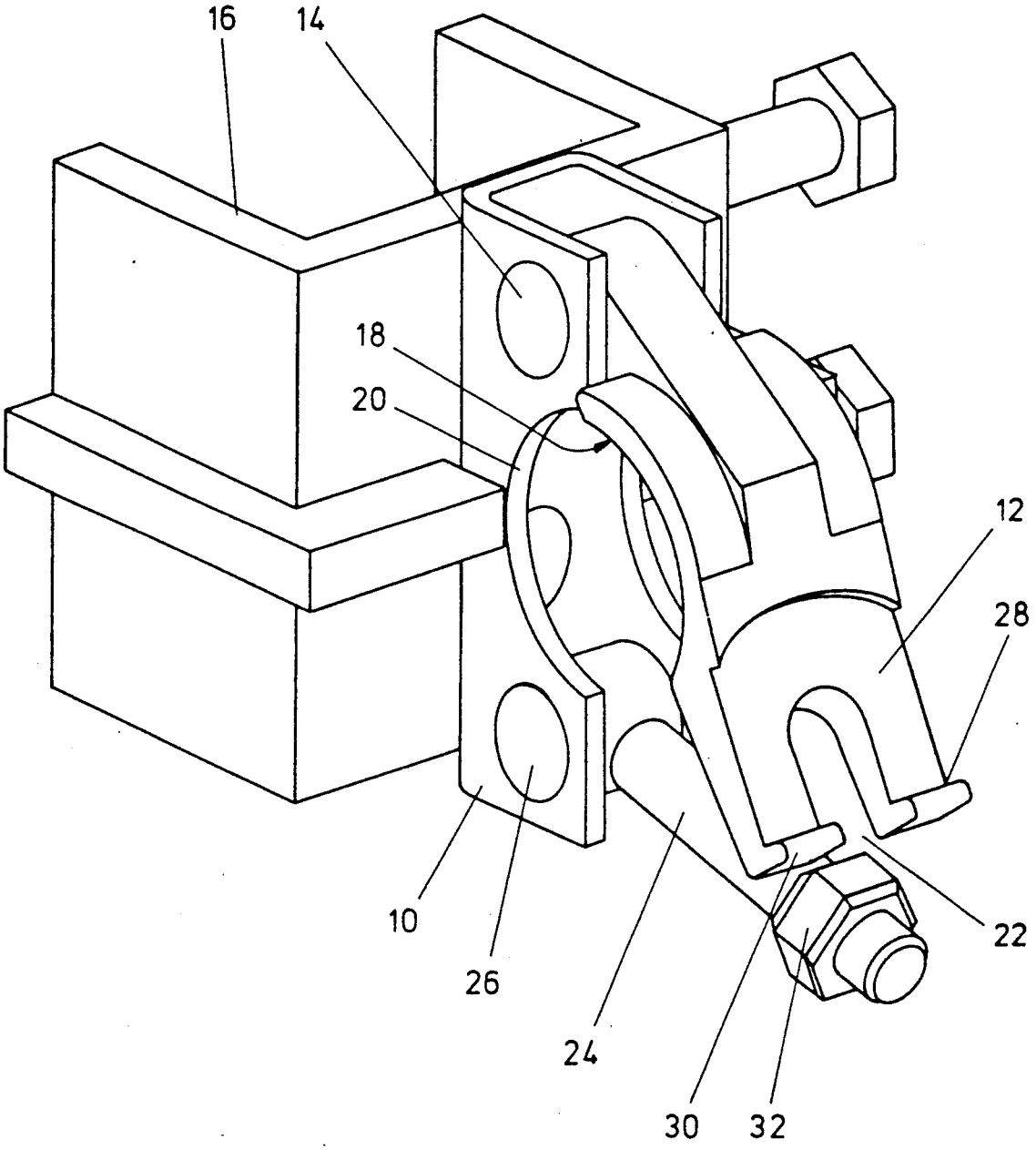
FIG. 1 is a perspective view of an exemplary scaffold fitting according to the invention.
Figure 2:
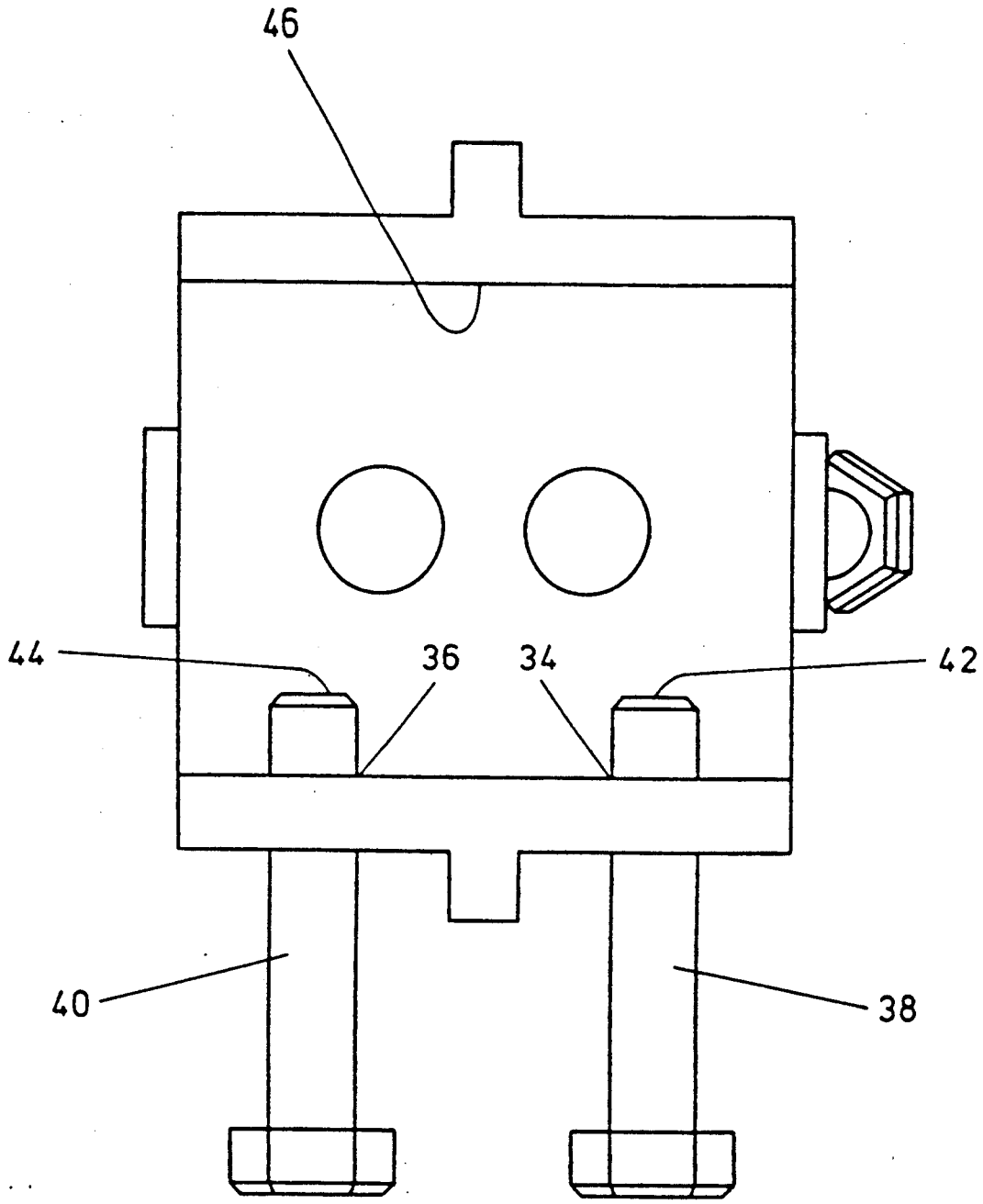
FIG. 2 is an underneath plan view of the fitting of FIG. 1.
Figure 3:
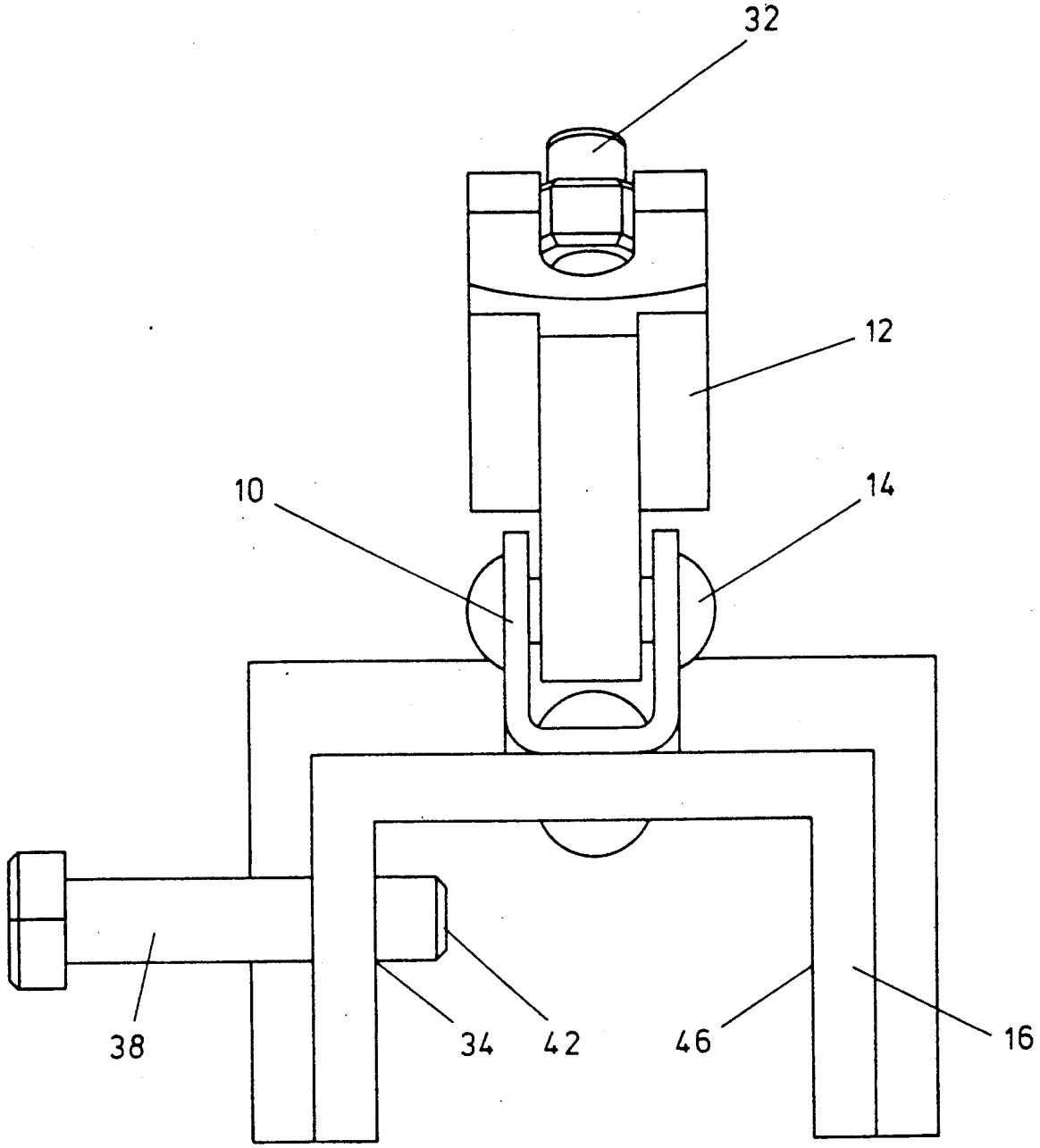
FIG. 3 is an end elevation of the fitting of FIG. 1.
Figure 4:
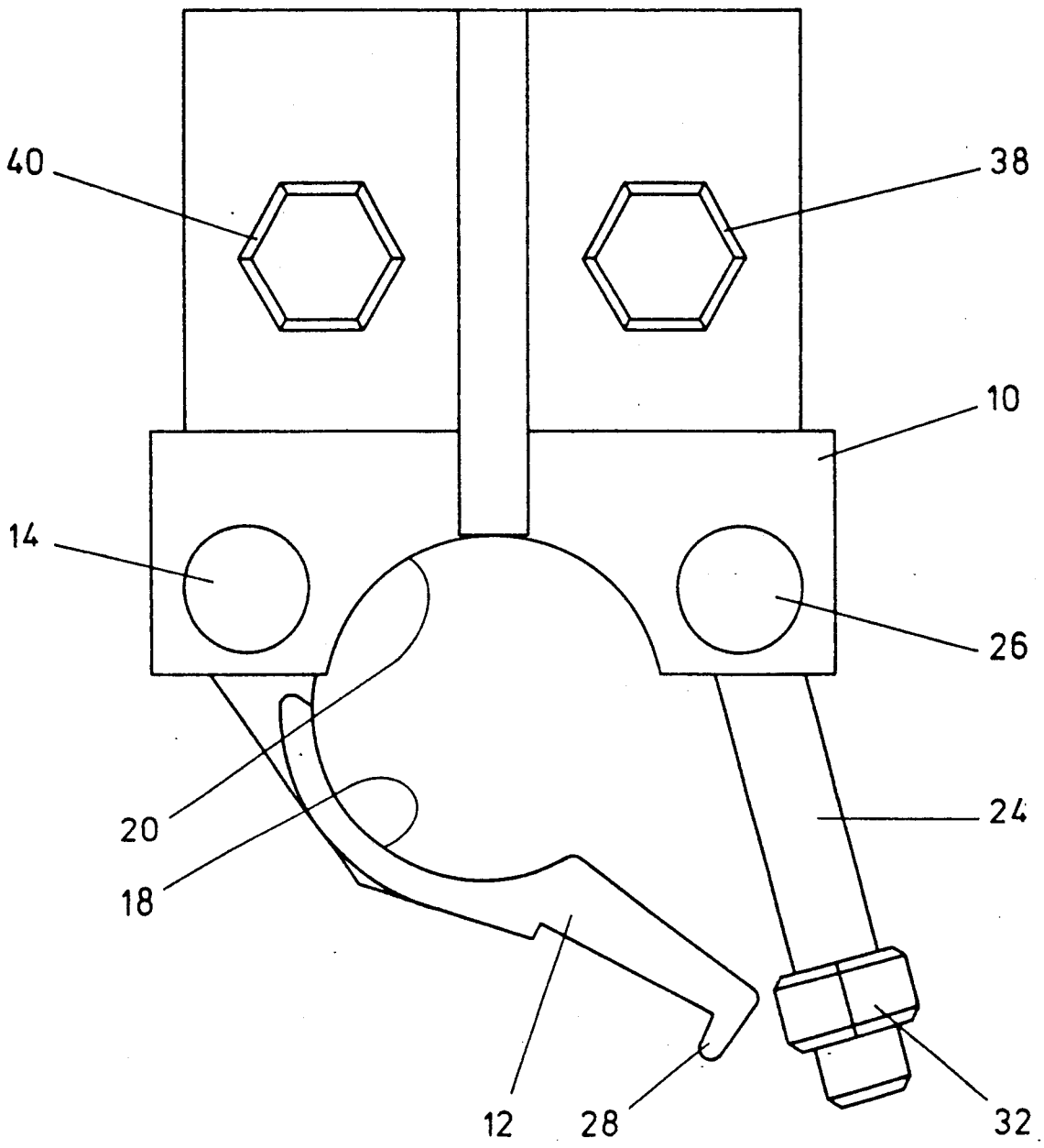
FIG. 4 is a side elevation of the fitting of FIG. 1.

Referring to the drawings, the scaffold fitting comprises a body 10 having a jaw 12 attached thereto via pivot pin 14, and a generally U-shaped channel section 16 which is integral with the body 10. The jaw 12 has a concave arcuate face 18 which faces a corresponding concave arcuate face 20 on body 10.

The end of jaw 12 remote from pivot pin 14 has an open-ended groove 22 arranged to receive a bolt 24, which is attached to body 10 by means of a further pivot pin 26. The ends of jaw 12, on either side of groove 22, are provided with lips 28, 30 capable of engaging a nut 32 affixed to bolt 24 when the latter is received in groove 22. When the bolt 24 is tightened to secure the jaw 12 to the body 10, the body and the jaw cooperate together to form a clamp in which the arcuate faces 18,20 are arranged to engage a tubular scaffolding member (not shown).

The channel section 16 has a pair of apertures 34, 36 each of which receives a respective bolt 38,40 which can be tightened to engage a plate (not shown) between the respective ends 42, 44 of bolts 38,40 and the internal surface 46 of the channel section 16 opposed to apertures 34,36. By this means, a tubular scaffold member can be connected directly perpendicular to a plate.

I claim:

1. A scaffold fitting for securing a scaffold tube to a steel plate or beam having a pair of opposed faces, said scaffold fitting comprising:

(a) a base portion having a concave arcuate surface;

(b) a pivotal jaw having a concave arcuate surface arranged to face the arcuate surface of said base portion, said jaw being pivotally mounted adjacent one end thereof to said base portion;

(c) clamping means provided on said base portion being arranged for engaging another end of said jaw and for drawing said jaw to said base portion and for gripping a scaffold tube between said facing arcuate surfaces;

(d) a unitary channel member being secured to an obverse of said base portion, said channel member comprising a connecting web member and a pair of opposed sidewalls, each of said sidewalls being in a fixed orientation relative to the other of said sidewalls and being arranged substantially perpendicular to the axis of said tube, free ends of said sidewalls being remote from said connecting web member; and (e) a plurality of bolts passing through corresponding threaded apertures in one of the sidewalls, said bolts being arranged substantially parallel to said connecting web member so that said bolts are able to be tightened directly on to one face of said steel plate of beam with the other face thereof being in engagement with the other of said sidewalls.

2. A scaffold fitting according to claim 1, wherein said channel member is pivotally connected to said base portion.

3. A scaffold fitting according to claim 2, wherein said channel member is pivotal between an orientation of said web portion perpendicular to the axis of the scaffold tube and a range of orientations of said web portion inclined thereto.

4. A scaffold fitting for securing a scaffold tube to a steel plate or beam having a pair of opposed faces, which scaffold fitting comprises:

(a) a base portion having a concave arcuate surface;

(a) a pivotal jaw having a concave arcuate surface arranged to face the arcuate surface of said base portion, said jaw being pivotally mounted adjacent one end thereof to said base portion;

(c) clamping means provided on said base portion being arranged for engaging another end of said jaw and for drawing said jaw to said base portion and for gripping a scaffold tube between said facing arcuate surfaces;

(d) a unitary channel member being integral with an obverse of said base portion, said channel member comprising a connecting web member and a pair of opposed sidewalls, each of said sidewalls being in a fixed orientation relative to another of said sidewalls and being arranged substantially perpendicular to the axis of said tube with free ends of said sidewalls being remote from said connecting web member; and, (e) a plurality of bolts passing through corresponding threaded apertures in one of the sidewalls, said bolts being arranged substantially parallel to said connecting web member so that said bolts are able to be tightened directly onto one face of said steel plate of beam with the other face thereof in engagement with the other of said sidewalls.

* * * * *

UNITED STATES PATENT AND TRADEMARK OFFICE

CERTIFICATE OF CORRECTION

PATENT NO. : 5,040,916

DATED : August 20, 1991

INVENTOR(S) : Richard M. Morgan

It is certified that error appears in the above-identified patent and that said Letters Patent is hereby corrected as shown below:

Claim 1, Col. 2, line 48, change "plate of beam" to read --plate or beam--.

Claim 4, Col. 4, line 8, change "plate of beam" to read --plate or beam--.

Signed and Sealed this

Nineteenth Day of January, 1993

*Attest:*

DOUGLAS B. COMER

*Attesting Officer*

*Acting Commissioner of Patents and Trademarks*